United States Patent [19]

Schenkel et al.

[11] 4,235,393

[45] Nov. 25, 1980

[54] METHOD AND APPARATUS FOR CONTINUOUSLY TAKING-OFF A THREAD ALTERNATELY FROM ONE OF TWO PARALLEL BOBBIN PACKAGE ARRANGED SIDE BY SIDE

[75] Inventors: Eduard Schenkel, Seuzach; Dieter Thalmann, Winterthur, both of Switzerland

[73] Assignee: Rieter Machine Works Ltd, Winterthur, Switzerland

[21] Appl. No.: 13,746

[22] Filed: Feb. 21, 1979

[30] Foreign Application Priority Data

Feb. 24, 1978 [CH] Switzerland ..... 200978

[51] Int. Cl.[3] ..... B65H 49/00

[52] U.S. Cl. ..... 242/128; 242/130

[58] Field of Search ..... 242/130, 131, 131.1, 242/157 R, 128; 66/125 R, 143

[56] References Cited

U.S. PATENT DOCUMENTS

| | | | |
|---|---|---|---|
| 2,202,937 | 6/1940 | Wolfe | 242/157 R |
| 2,534,340 | 12/1950 | Chaya et al. | 242/128 |
| 2,588,053 | 3/1952 | Smith et al. | 242/157 R |

FOREIGN PATENT DOCUMENTS

| | | | |
|---|---|---|---|
| 1145527 | 3/1963 | Fed. Rep. of Germany | 242/131 |
| 43-10851 | 1/1968 | Japan | 242/131 |

*Primary Examiner*—Leonard D. Christian
*Attorney, Agent, or Firm*—Werner W. Kleeman

[57] ABSTRACT

A method of, and apparatus for, taking-off a thread or the like alternately from one of two bobbin packages arranged side by side in a creel for textile machines. The method contemplates taking-off a thread from a bobbin package, the tail end of such removed thread being knotted to the lead end of an essentially parallelly arranged reserve bobbin package. The knot is formed by first pulling the leading thread end of the reserve bobbin package through a thread take-off opening operatively associated with such reserve bobbin package. Then the thread is pulled in a direction opposite to the thread take-off direction through or at a location near a take-off opening operatively associated with the bobbin package from which thread is in the process of being removed, in other words the momentary withdrawal bobbin package. A loop, which progressively disappears as the thread take-off process switches-over to the reserve bobbin package, is formed by the knot connecting the leading end of the reserve bobbin package to the tail end of the bobbin package being unwound.

The apparatus for performing the method is mounted upon a support member of the bobbin package creel and is provided with two pivotable wing members which extend upwardly at an inclination, each wing member having an extended or elongate opening. Two wires mounted on each wing member form the related thread take-off opening. Each such thread take-off opening is arranged in the extension of the bobbin axis of the associated bobbin package when the related wing member is in its working position.

20 Claims, 6 Drawing Figures

METHOD AND APPARATUS FOR CONTINUOUSLY TAKING-OFF A THREAD ALTERNATELY FROM ONE OF TWO PARALLEL BOBBIN PACKAGE ARRANGED SIDE BY SIDE

BACKGROUND OF THE INVENTION

The present invention relates to a new and improved method of, and apparatus for, continuously taking-off a thread alternately from one of two essentially parallel bobbin packages arranged in side by side relationship.

Machines for processing textile threads or yarns or similar filamentary material—hereinafter usually simply conveniently referred to as "threads"—require the in-feed of unprocessed threads. The thread supply is to be carried out continuously for reasons of economy. Thus, for instance, a texturing machine is equipped with a plurality of processing positions or stations. Each processing station is supplied with a thread which is taken-off a bobbin package arranged on a creel having a large number of bobbin packages near the machine. Adjacent to each bobbin package from which there is removed the thread as required, there is arranged a reserve bobbin package. The thread ends of both bobbins or bobbin packages are interconnected in a manner such that as the first bobbin package is depleted, the thread automatically is taken-off the second or reverse bobbin package. The depleted bobbin package then is changed for a full bobbin package which, in turn, now assumes the role of the reserve bobbin package. In this way it is possible to maintain a continuous supply of unprocessed threads to each processing position or station of the processing machine.

The textile art is acquainted with an arrangement of two bobbin packages in a creel, one such bobbin package serving as a reserve bobbin package. Normally, the two bobbin packages are arranged at an angle with respect to one another, and the extension of the two bobbin axes intersect at a common thread guide in a manner such that a thread can be removed, through this thread guide, from the one as well as the other bobbin package. One drawback of such type arrangement resides in the large amount of space which is required by the bobbin packages in the creel. This has been found to be particularly disadvantageous, for instance, in a texturing machine having a large number of processing positions or stations, requiring a plurality of creels.

In an attempt to alleviate or avoid this shortcoming British Pat. No. 1,372,553 proposes an arrangement of the bobbins in a creel wherein the bobbin packages are vertically supported essentially parallel to one another and side by side. To permit guiding of the thread from two bobbin packages to a common thread guide, there is arranged a rod between the common thread guide. The thread can slide upon such rod during such time as the thread which is being taken-off changes from the one bobbin package to the reserve bobbin package. Apart from the unstable guiding of the thread upon the rod during the thread take-off operation, this state-of-the-art arrangement is afflicted with the disadvantage that it is not applicable for use with horizontally supported bobbin packages. Yet, a horizontal bobbin package support arrangement affords many advantages over the vertical bobbin package support arrangement. For instance, there is considerably simplified supplying the creel with full bobbins, mounting of the bobbin packages is much more reliable and simpler, the thread layers cannot slide-off from badly wound bobbin packages, and there is afforded a more effective utilization of the available space.

SUMMARY OF THE INVENTION

Therefore, with the foregoing in mind it is a primary object of the present invention to provide an improved method of, and apparatus for, continuously removing a thread in alternate fashion from one of two essentially parallel bobbin packages arranged side by side in a manner not afflicted with the shortcomings noted heretofore, while realizing the benefits of essentially horizontally arranged bobbin packages.

Another and more specific object of the invention is to insure for positive and reliable thread transfer from each of two horizontally supported bobbin packages arranged in parallelism and side by side relationship to a common thread guide.

Yet a further significant object of the present invention aims at the provision of a novel method of, and apparatus for, continuously taking-off a thread in alternate fashion from one of two essentially parallel bobbin packages arranged side by side in an efficient and reliable manner, affording easy knotting of the leading end of the thread of the reserve bobbin package of such two bobbin packages with the tail end of the thread of the other bobbin package from which the thread is in the process of being wound off.

Still a further object of the present invention is to provide a new and improved construction of apparatus for continuously taking-off a thread alternately from one of two parallel bobbin packages arranged in side by side relationship, which apparatus is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the method of continuously taking-off a thread alternately from one of two bobbin packages arranged side by side in a creel for textile machines to a common thread guide, and wherein the tail end of the thread of one bobbin package is knotted to the leading end of the thread of the other bobbin package serving as a reserve, contemplates that for forming the knot the leading thread end of the bobbin package serving as a reserve is guided in the thread take-off direction through a thread take-off opening associated with this reserve bobbin package, the removed thread is then subsequently guided in a direction opposite to the thread take-off direction at least near to a thread take-off opening operatively associated with the other bobbin package from which the thread is being taken-off or removed, and such leading thread end is knotted to the tail thread end of such other bobbin package.

As mentioned above, the invention is not only concerned with such method aspects, but also relates to apparatus for the performance thereof. Upon a support member of the creel there are mounted two wing members or equivalent structure, each having a thread take-off opening for the passage of two threads. One of the threads, typically the leading end of the thread emanating from the reserve bobbin package is threaded and taken-off through the one take-off opening of the wing member operatively associated with such reserve bobbin package, in the take-off direction of such thread, and is then guided in a direction opposite to the thread take-off direction at least near to the other thread take-off opening operatively associated with the other bobbin package which then constitutes the so-called withdrawal bobbin package, i.e., the bobbin package from which the thread is being withdrawn or unwound. These thread take-off openings are each arranged in the extension of the bobbin axis of the related bobbin package.

As will be apparent from the disclosure of the various exemplary embodiments to follow, in the context of this description and in the appended claims, the term "at least near to", as used in conjunction with the thread take-off opening coordinated to the bobbin package from which the thread is in the process of being wound-off, is used in a broader sense, to the extent that the context permits, as meaning near to such thread take-off opening or at such thread take-off opening.

According to an advantageous embodiment of the apparatus the support member can be arranged essentially parallel to the horizontally supported bobbin packages and each wing member can be arranged so as to extend upwardly at an inclination. Also, each wing member can be provided with a longitudinally extending opening or elongated slot. Furthermore, each thread take-off opening can be formed by a wire extending over the longitudinally extending opening, such wire being angled-off or flexed at its upper or one end, and by a substantially U-shaped wire mounted above and in spaced relationship from the first mentioned wire. These wires, if desired, can be provided with a ceramic coating or equivalent structure facilitating sliding of the threads. Each wing member can be mounted upon the support member by means of a hinge structure or hinge means and can be arrested in a working position by a suitable arresting device, for instance a holding spring.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
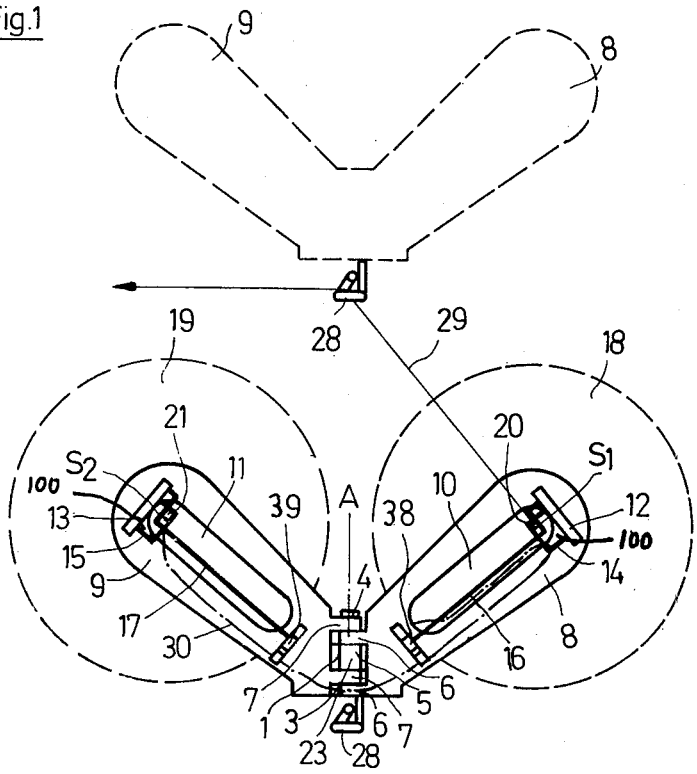
FIG. 1 is a front view of a first exemplary embodiment of thread take-off apparatus according to the invention and useful for the practice of the method aspects.

Describing now the drawings, it is to be understood that for purposes of simplifying the illustration only enough of the structure of the textile equipment with which the invention is used has been shown, more specifically the bobbin creel, as will enable those skilled in the art to readily understand the underlying principles and concepts of the invention. Turning attention now to the drawings, upon an essentially horizontal support member 1, shown in FIG. 2, of a standard bobbin creel, now shown in greater detail, and supplying a textile machine with threads or the like, there is mounted a plate 3 by means of, for instance, two screws or threaded bolts 2 or equivalent fastening expedients. The plate 3 surrounds or straddles an essentially vertically arranged hinge pin 4 of a hinge or pivot means 5. This plate 3 serves as a support or mounting means for the hinge or pivot means 5. Pivotably supported for swivel movement about the vertical hinge axis A are two wing members 8 and 9 or equivalent structure, formed, by way of example, from sheet metal, although obviously other materials could be used. These two wing members 8 and 9 are pivotably supported on the hinge pin 4 by means of two hinge members 6 and 7. As shown, the hinge members 6 support the wing member 8 and the hinge members 7 the wing member 9.

Continuing, it will be observed by referring to FIG. 1 that the wing members 8 and 9 are constructed to be axially symmetrical and in their working position are arranged at an inclination of about 45° with respect to the hinge axis A and essentially at right angles with respect to the support member 1. Each wing member 8 and 9 is thus arranged so as to extend upwardly at an inclination. Further, each such wing member 8 and 9 is provided with a respective longitudinally extending opening or elongate slot 10 and 11. At the end of each such opening 10 and 11 which is remote from the hinge or pivot means 5 there is provided a substantially rectangular member 12 and 13 which is rigidly connected to the related wing member 8 and 9. There are mounted in not particularly shown bores of the rectangular members 12 and 13 a respective substantially U-shaped wire 14 and 15, and equally, the angled-off or flexed end 16' and 17' of a respective straight wire 16 and 17. The U-shaped wire 14 and its adjacent wire 16 of the wing member 8 are positioned so that these wires do not contact one another at their respective crossing or overlapping points, and the same is true for the wires 15 and 17 of the other wing member 9. The other respective end 16'' and 17'' of the corresponding wires 16 and 17, and which wires are arranged in the embodiment of FIG. 3 between the related wing member and the U-shaped wire at a small spacing, is held in a related holder 38 and 39. Each such holder or support 38 and 39 is rigidly connected with the corresponding wing member 8 and 9 at the other end of the extended opening or slot 10 and 11, in other words at the slot ends closer to the hinge means 5.

Each U-shaped wire 14 and 15 and its related straight wires 16 and 17, respectively, the upper end of each of which is angled-off as mentioned, are arranged in such a manner that, considered with respect to the extension of the bobbin axes $S_1$ and $S_2$ of the horizontally supported bobbin packages 18 and 19, respectively, shown in broken lines in FIG. 1, they form a related thread take-off opening 20 and 21. Each such thread take-off opening 20 and 21 is dispositioned approximately concentrically with respect to the related bobbin package 18 and 19, respectively. Furthermore, with the arrangement of FIGS. 1 to 3, each wire 16 and 17, as mentioned, is arranged between its related wire 14 and 15 and related wing member 8 and 9, respectively. Yet, as will be explained further, for instance with respect to the arrangement of FIG. 4, a different arrangement of such wires is equally possible. Moreover, in all of the embodiments herein disclosed, in order to improve the thread running properties and the wear characteristics, the wires 14, 15, 16 and 17 are preferably coated with a ceramic material or other material appropriate for these purposes.

Figure 2:
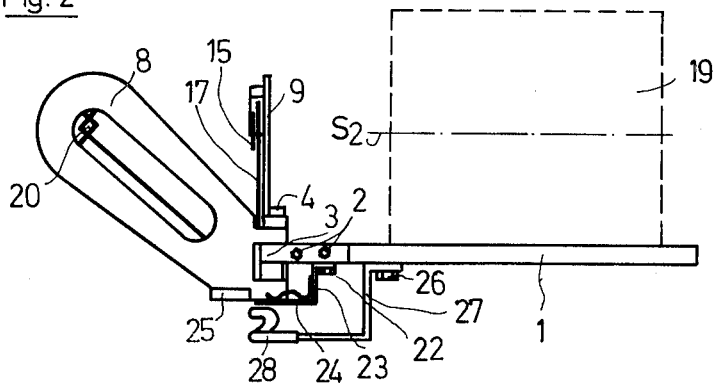
FIG. 2 is a view looking from the right-hand side of the apparatus shown in FIG. 1, wherein the right-hand wing member has been portrayed in a position where it is pivoted away from its working position.

An angle member 23 is fixed by a screw or threaded bolt 22 or equivalent fastening structure to the lower side or face of the support member 1. Arresting means, here shown in the form of, for instance, two curved flat springs 24, of which only the one flat spring associated with the wing member 8 is shown in FIG. 2, are arranged on the angle member 23. The lower end of each wing member 8 and 9 forms a stop 25. In the working position of each wing member 8 and 9, as shown in FIG. 1, and indicated in FIG. 2 for the wing member 9, each stop 25 is arrested or releasably fixed in its related flat spring 24 so that the corresponding wing member is held in its working or work position. On the lower side of the support member 1 there is likewise fixed by means of a screw or threaded bolt 26 or equivalent fastening structure a thread guide 27 which is operatively associated with a further pair of bobbin packages arranged in the creel below the depicted apparatus, and the actual thread guide portion, here shown as the eyelet 28, is beneficially covered by a ceramic coating or the like.

Now during the thread take-off process the wing members 8 and 9 are located in their working position as shown in FIG. 1. The thread 29 which is in the process of being taken-off from the right-hand bobbin package 18, assumed at this point in time to constitute the withdrawal bobbin package, is guided by means of the thread take-off opening 20 to the eyelet 28 of the thread take-off apparatus shown in phantom lines in FIG. 1 and arranged in the creel vertically above the described thread take-off apparatus. From this location the thread 29 is then guided to a suitable processing station or position, not here further shown, of the relevant textile machine, such as, by way of example, a texturing machine. The leading thread end 30, indicated with dash-dotted lines, of the left-hand shown bobbin package 19, which then at this point in time is assumed to constitute the reserve bobbin package, is inserted, in the thread take-off direction, through the thread take-off opening 21 of the wing member 9 and is loosely placed on the holders or supports 38 and 39 which also therefore serve to hold the reserve thread.

Figure 3:
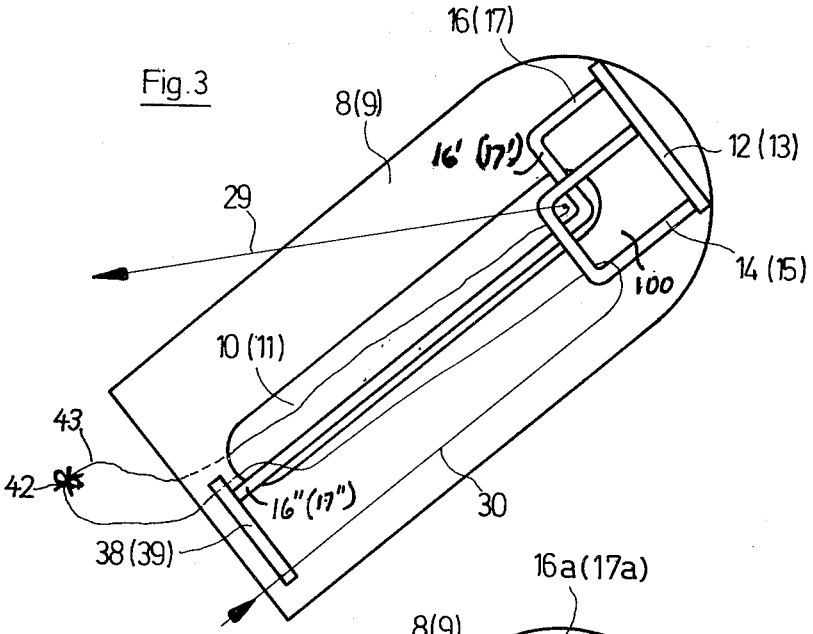
FIG. 3 is a schematic view showing a detail of the apparatus of FIG. 1.

Furthermore, as best seen by referring to FIGS. 1 and 3, this leading thread end 30 of the reserve bobbin package 19 is inserted into the lower corner or opening region 100 of the substantially U-shaped wire 14. This corner portion or opening region 100 may be considered to be part of or contiguous to the thread take-off opening 20 of the wing member 8. The thus drawn leading thread end 30 extends approximately parallel to the wire 16 before it is guided into the extended opening or slot 10 at the lower region thereof. Behind the wing member 8 the leading thread end 30 is knotted, as indicated by the knot 32, to the tail thread end of the bobbin package 18 and is deposited upon a not particularly shown, bobbin protection plate or the like. Owing to this arrangement, wherein the thread connection with the reserve bobbin package hangs under its own weight on the U-shaped wire 14 and only extends at the end of the elongate or extended opening 10, over the wire 16 to a location behind the wing member 8, the thread take-off process from the bobbin package 18 can be carried out substantially spatially separated from the thread connection.

Now as soon as the thread has been completely removed from the bobbin package 18 down to its tail end, then the loop-shaped thread portion 43, formed by the knotting process when there is formed the knot 42 and interconnecting the threads of the two bobbin packages as explained above, is pulled up along the straight portion of the wire 16 to the U-shaped wire 14 and is pulled out of the thread take-off opening 20, whereupon the thread removal operation through the eyelet 28 coordinated with the bobbin packages 18 and 19, automatically switches-over to the bobbin package 19. Due to this switching of the thread take-off process the bobbin package 19, previously constituting the reserve bobbin package, now assumes the role of the withdrawal bobbin package from which the thread is unwound. While the thread now is being removed from the bobbin package 18, the wing member 8 is pivoted out of its working position, into the position shown in FIG. 2, in order to conveniently doff the empty bobbin and to don a new full bobbin package. The leading thread end of the new full bobbin package is now inserted through the thread take-off opening 20 of the wing member 8, then placed onto the holders 38 and 39, guided through the corresponding opening portion 100 of the U-shaped wire 15, and at the lower end of the extended or elongated opening 11 is guided over the straight wire 17. Thereupon the leading thread end is knotted to the tail thread end of the bobbin package 19 and is deposited onto the bobbin protection plate. After the wing member 8 has been pivoted back and arrested in its working position the newly donned bobbin package is ready as a reserve bobbin package. By using the described apparatus it will be evident from what has been explained above that there is rendered possible continuous thread take-off, permitting the supply of thread to a subsequent processing station of a textile machine to be accomplished without interruption. As will be also clearly evident from what has been discussed above, the foregoing described operations can be repeated so that continuous thread take-off, from two bobbin packages in alternation, can be carried out, thereby effectively satisfying the thread supply demand prevailing at the related textile machine.

Figure 4:
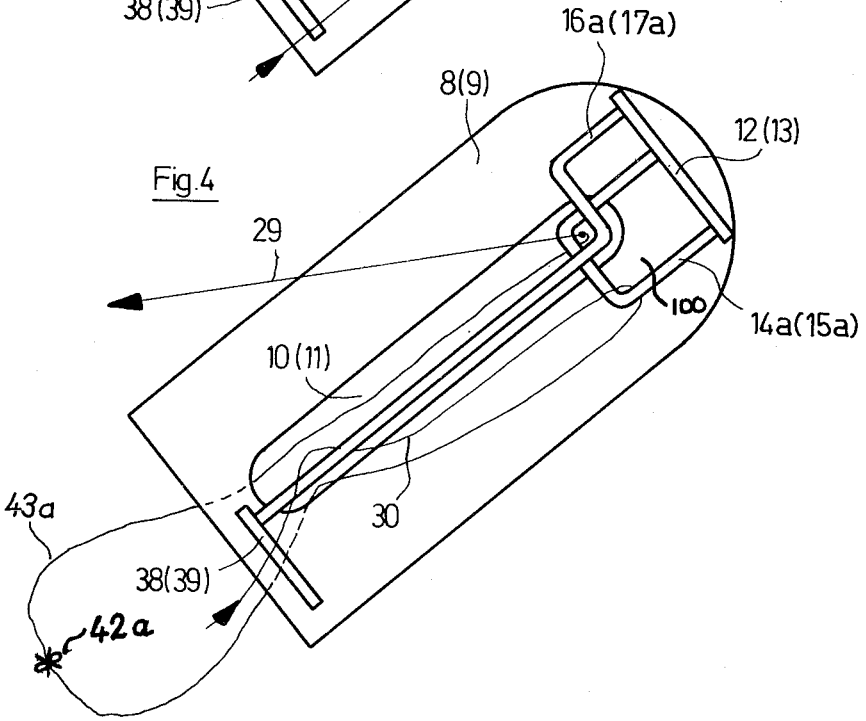
FIG. 4 is a schematic view of a modified embodiment of the detail showing of FIG. 3.

According to a modified embodiment, differing from the one shown and described above with respect to FIGS. 1, 2 and 3, and as illustrated in FIG. 4, each of the U-shaped wires **14*a* and 15*a* can be arranged between the related wire 16*a* and 17*a* and wing members 8 and 9, respectively. The corresponding thread path of the leading thread end 30, as shown in FIG. 4, is here arranged such that the leading thread end 30 first is guided at the lower end of the extended or elongated opening 10 or 11, onto the related wires 16*a* or 17*a* and below the same, then is guided in a direction opposite to the direction of travel of the thread 29 through the opening porton 100 of the related U-shaped wire 14*a* or 15*a*, and subsequently is guided at the lower end of the elongated opening 10 or 11, as the case may be, through such opening, then is knotted into a knot 42*a* to the tail thread end of the bobbin package 18 or 19, in such a manner that upon completion of the thread take-off process from the withdrawal bobbin package, here assumed in FIG. 4 to be for instance the bobbin package 18, there is formed the loop 43*a***.

Figure 5:
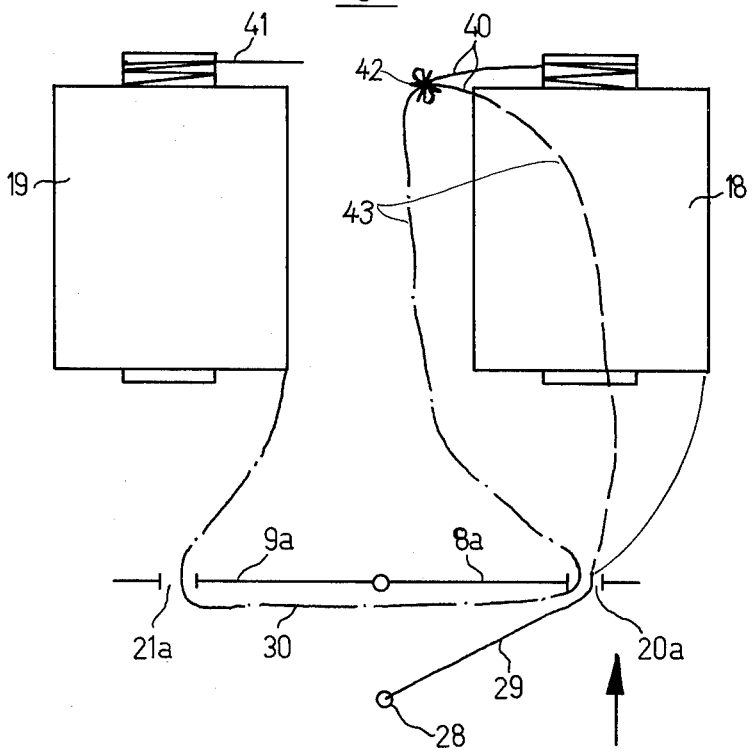
FIG. 5 is a schematic top plan view of a further embodiment of thread take-off apparatus from the arrangement of FIG. 1.
Figure 6:
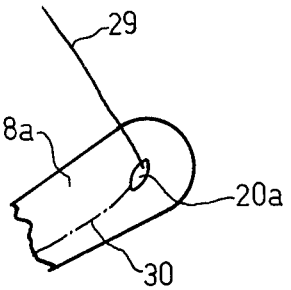
FIG. 6 is a fragmentary detail showing of part of the thread take-off apparatus portrayed in FIG. 5.

Finally, in the still further modified embodiment of apparatus shown in FIGS. 5 and 6, there has been shown in simplified and schematic illustration the basic embodiment of apparatus for implementing the method aspects. The wing members 8a and 9a are each provided with a respective thread take-off opening 20a and 21a of a type such that the leading thread end 30 of the reserve bobbin package 19 can be inserted, without disturbing the thread 29 which is in the process of being taken-off, in a direction opposite to the thread take-off direction through the opening 20a (or through the opening 21a when the bobbin package 18 is the reserve), and as previously described, can be knotted to the tail thread end 40 (or the tail thread end 41 after the next change-over operation) of the bobbin package in which the thread is in the process of being taken-off.

Furthermore, each take-off opening 20a and 21a is designed such that the portion guiding the thread 29 which is being taken-off is arranged substantially concentrically with respect to the bobbin axis $S_1$ and $S_2$ of the related bobbin package 18 and 19, respectively.

Furthermore, in FIG. 5 there is illustrated the loop 43, formed by the leading thread end 30 and the tail thread end 40 (indicated with broken lines), which is to be finally pulled through the thread take-off opening, here at the moment assumed to be the opening 20a, after completion of the thread take-off process from the withdrawal bobbin package 18.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method of continuously taking-off a thread alternately from one of two bobbin packages arranged side by side in a creel for textile machines to a common thread guide, wherein one of the bobbin packages momentarily serves as a reserve bobbin package and the other bobbin package as a withdrawal bobbin package from which the thread is in the process of being unwound, comprising the steps of:

guiding the leading thread end of the reserve bobbin package, in the thread take-off direction, through a thread take-off guide opening operatively associated with such reserve bobbin package for guiding thread during take-off from said reserve bobbin package;

then guiding the thus removed leading thread end, in a direction opposite to said thread take-off direction, through a location at least near to and communicating with a thread take-off guide opening operatively associated with the withdrawal bobbin package from which the thread is being unwound for guiding thread during take-off from said withdrawal bobbin package; and knotting the leading thread end to a tail thread end of the withdrawal bobbin package.

2. The method as defined in claim 1, wherein:

the step of guiding the leading thread end through a location at least near to said thread take-off guide opening operatively associated with the withdrawal bobbin package comprises guiding such leading thread end at such thread take-off guide opening which lies on the bobbin package axis.

3. The method as defined in claim 1, wherein the step of guiding the leading thread end through a location at least near to the thread take-off guide opening operatively associated with the withdrawal bobbin package comprises guiding such leading thread end at a location in close proximity to such thread take-off guide opening which lies on the bobbin package axis.

4. An apparatus for continuously taking-off a thread alternately from one to two bobbin packages arranged side by side in a creel for textile machines and having a common thread guide, wherein the tail thread end of one bobbin package is knotted to the leading thread end of the other bobbin package the one bobbin package momentarily serving as the withdrawal bobbin package from which the thread is unwound and the other bobbin package as the reserve bobbin package, each bobbin package having a bobbin package axis, comprising:

support means;

two wing members, each of which is operatively associated with one of the bobbin packages;

means for mounting said two wing members at said support means;

each of said wing members having means defining a respective thread take-off opening for the passage of a thread from the related bobbin package therethrough;

said mounting means serving to mount said two wing members such that each thread take-off opening thereof is arranged in the extension of the bobbin package axis of the related bobbin package;

said two bobbin packages being arranged so as to define essentially horizontally supported bobbin packages;

said support means comprising a support member arranged essentially parallel to said horizontally supported bobbin packages; and each wing member being arranged to extend upwardly at an inclination.

5. The apparatus as defined in claim 4, wherein:

said means defining each respective thread take-off opening at each wing member includes structure providing an opening region through which a thread can be guided in a direction opposite to the take-off direction of the thread extending from the related bobbin package through such take-off opening.

6. The apparatus as defined in claim 5, wherein:

the opening region at each wing member is located near to the related thread take-off opening thereof.

7. The apparatus as defined in claim 5, wherein:

the opening region of each wing member is located substantially at the thread take-off opening of such wing member.

8. The apparatus as defined in claim 4, wherein:

each wing member is provided with an extended opening.

9. An apparatus for continuously taking-off a thread alternately from one of two bobbin packages arranged side by side in a creel for textile machines and having a common thread guide, wherein the tail thread end of one bobbin package is knotted to the leading thread end of the other bobbin package the one bobbin package momentarily serving as the withdrawal bobbin package from which the thread is unwound and the other bobbin package as the reserve bobbin package, each bobbin package having a bobbin package, comprising:

support means;

two wing members, each of which is operatively associated with one of the bobbin packages;

means for mounting said two wing members at said support means;

each of said wing members having means defining a respective thread take-off opening for the passage of a thread from the related bobbin package therethrough;

said mounting means serving to mount said two wing members such that each thread take-off opening thereof is arranged in the extension of the bobbin package axis of the related bobbin package;

each wing member being provided with an extended opening; and each thread take-off opening being formed by a wire extending over the extended opening of the related wing member and having an angled portion at an end region thereof and by a substantially U-shaped wire arranged over said extending wire.

10. The apparatus as defined in claim 9, wherein:

said extending wire and said substantially U-shaped wire are arranged at a mutual spacing from one another on the related wing member.

11. The apparatus as defined in claim 9, wherein:

both said wires constitute ceramic-coated wires.

12. The apparatus as defined in claim 4, wherein:

said mounting means for mounting said wing members at the support means including vertically arranged hinge means for pivotably mounting said wing members.

13. An apparatus for continuously taking-off a thread alternately from one of two bobbin packages arranged side by side in a creel for textile machines and having a common thread guide, wherein the tail thread end of one bobbin package is knotted to the leading thread end of the other bobbin package the one bobbin package momentarily serving as the withdrawal bobbin package from which the thread is unwound and the other bobbin package as the reserve bobbin package, each bobbin package having a bobbin package axis, comprising:

support means;

two wing members, each of which is operatively associated with one of the bobbin packages;

means for mounting said two wing members at said support means;

each of said wing members having means defining a respective thread take-off opening for the passage of a thread from the related bobbin package therethrough;

said mounting means serving to mount said two wing members such that each thread take-off opening thereof is arranged in the extension of the bobbin package axis of the related bobbin package;

said mounting means for said wing members incorporate pivot means for mounting said wing members to be movable between a working position and an ineffectual position; and means for arresting each of the wing members in its working position.

14. The apparatus as defined in claim 13, wherein:

said arresting means comprises holding spring means.

15. An apparatus for continuously taking-off a thread alternately from one of two bobbin packages arranged side by side in a creel for textile machines and having a common thread guide, wherein the tail thread end of one bobbin package is knotted to the leading thread end of the other bobbin package the one bobbin package momentarily serving as the withdrawal bobbin package from which the thread is unwound and the other bobbin package as the reserve bobbin package, each bobbin package having a bobbin package axis, comprising:

support means;

two wing members, each of which is operatively associated with one of the bobbin packages;

means for mounting said two wing members at said support means;

each of said wing members having means defining a respective thread take-off opening for the passage of a thread from the related bobbin package therethrough;

said mounting means serving to mount said two wing members such that each thread take-off opening thereof is arranged in the extension of the bobbin package axis of the related bobbin package; and said mounting means for said wing members comprising structure for enabling pivoting of each of the wing members into a working position.

16. An apparatus for continuously taking-off a thread alternately from one of two bobbin packages arranged side by side in a creel for textile machines and having a common thread guide, wherein the tail thread end of one bobbin package is knotted to the leading thread end of the other bobbin package the one bobbin package momentarily serving as the withdrawal bobbin package from which the thread is unwound and the other bobbin package as the reserve bobbin package; each bobbin package having a bobbin package axis, comprising:

support means;

two wing members, each of which is operatively associated with one of the bobbin packages;

means for mounting said two wing members at said support means;

each of said wing members having means defining a respective thread take-off opening for the passage of a thread from the related bobbin package therethrough;

said mounting means serving to mount said two wing members such that each thread take-off opening thereof is arranged in the extension of the bobbin package axis of the related bobbin package; and each thread take-off opening being formed by a pair of mutually spaced cooperating elements fixedly mounted relative to each other.

17. A thread guide means for use with an apparatus for continuously taking-off a thread from a plurality of bobbin packages wherein the tail end of one bobbin package is knotted to the leading end of another bobbin package, said thread guide means comprising:

a first element defining a thread-receiving opening;

a second element fixedly mounted relative to the first element;

said second element defining with a first part of said thread-receiving opening a thread take-off guide opening such that a thread looped with a second part of said thread-receiving opening can be drawn into said thread take-off guide opening;

said first and second elements being essentially elongate and intersect when viewed along a thread travel path passing through said thread take-off guid opening;

said first element possessing a substantially U-shaped configuration viewed along said thread travel path;

said U-shaped first element having a corner; and said second element intersecting said first element at a location adjacent said corner.

18. A thread guide means for use with an apparatus for continuously taking-off a thread from a plurality of bobbin packages wherein the tail end of one bobbin package is knotted to the leading end of another bobbin package, said thread guide means comprising:

a first element defining a thread-receiving opening;

a second element fixedly mounted relative to the first element;

said second element defining with a first part of said thread-receiving opening a thread take-off guide opening such that a thread looped with a second part of said thread-receiving opening can be drawn into said thread-take-off guide opening; and said first and second elements being essentially elongate and intersect when viewed along a thread travel path passing through said thread take-off guide opening.

19. The means as defined in claim 18, further including:

mounting means for mounting said first and second elements;

said mounting means including a mounting member having an elongate slot;

said first and second elements extending across said slot to form said thread take-off guide opening at a first position aligned with said slot; and said second element extending from its intersection with the first element to join the mounting member at a second position spaced along the slot from said intersection.

20. The means as defined in claim 19, wherein:

said first and second elements intersect to form said thread take-off guide opening adjacent one end of the slot; and said second position is located adjacent the other end of the slot.

* * * * *

UNITED STATES PATENT AND TRADEMARK OFFICE

CERTIFICATE OF CORRECTION

PATENT NO. : 4,235,393

DATED : November 25, 1980

INVENTOR(S) : EDUARD SCHENKEL and DIETER THALMANN

It is certified that error appears in the above-identified patent and that said Letters Patent are hereby corrected as shown below:

Column 8, line 5, after "from one", delete "to"

and insert --of--

Signed and Sealed this

*Ninth* Day of *June 1981*

[SEAL]

*Attest:*

RENE D. TEGTMEYER

*Attesting Officer* *Acting Commissioner of Patents and Trademarks*